US005257565A

United States Patent [19]

Hung

[11] Patent Number: 5,257,565

[45] Date of Patent: Nov. 2, 1993

[54] CORKSCREW

[76] Inventor: Jui-Ching Hung, No. 29, Chung-Hsing Rd., Chieh-Shou Li, Changhua City, Taiwan

[21] Appl. No.: 23,041

[22] Filed: Feb. 25, 1993

[51] Int. Cl.[5] ..... B67B 7/04

[52] U.S. Cl. ..... 81/3.29

[58] Field of Search ..... 81/3.29, 3.07, 3.09, 81/3.36, 3.45, 3.48

[56] References Cited

U.S. PATENT DOCUMENTS

| | | | |
|---|---|---|---|
| 1,421,169 | 6/1922 | Chmura | 81/3.29 |
| 4,570,512 | 2/1986 | Pracht | 81/3.29 |
| 4,800,784 | 1/1989 | Allen | 81/3.36 |

*Primary Examiner*—D. S. Meislin

*Attorney, Agent, or Firm*—Panitch Schwarze Jacobs & Nadel

[57] ABSTRACT

A corkscrew includes a hollow tubular protective body having an open upper end and an open lower end; a cork drawing assembly being connected rotatably to the protective body and including a spiral drawing element which has a pointed lower end and that extends into the protective body through the open upper end of the protective body; a coiled spring being disposed in the protective body and surrounding the spiral drawing element; a positioning member disposed movably in the protective body and biased away from the upper end of the protective body by the coiled spring, the positioning member permitting extension of the pointed lower end of the spiral drawing element therethrough and into a cork of a bottle and having a plurality of sharp protrusions adapted to be inserted into the cork of the bottle; and a sleeve member connected securely to the open lower end of the protective body so as to prevent disengagement of the positioning member from the protective body through the lower end of the protective body, the sleeve member being adapted to engage a neck of the bottle so as to prevent tilting of the corkscrew relative to the bottle when the spiral drawing element of the cork drawing assembly is inserted into the cork of the bottle and is rotated.

3 Claims, 4 Drawing Sheets

CORKSCREW

BACKGROUND OF THE INVENTION

1. Field Of The Invention

This invention relates to a corkscrew, more particularly to a corkscrew in which a pointed portion of the corkscrew is hidden in order to prevent accidents.

2. Description Of The Related Art

Champagne is usually drunk on special occasions. The bottle of champagne is closed by a cork. A popping sound is generated when the cork is pulled away from the bottle due to the pressure in the bottle. A conventional corkscrew includes a handle and a spiral drawing element which is connected securely to the handle and which has a pointed end. The conventional corkscrew is operated by rotating the handle so as to rotate correspondingly the pointed end of the spiral drawing element in order to insert the spiral drawing element into the cork of the bottle. A pulling force is then applied to pull the cork away from the bottle. In the above-described operation, one hand of the user rotates the handle while the other hand grasps the bottle. Therefore, injury to the hand which grasps the bottle can be caused by the open pointed end of the spiral drawing element when the corkscrew is operated careless. Moreover, injury to a child can occur when he is playing with the corkscrew. Furthermore, if an excessive pulling force is applied, the user's clothes will be sprayed with the champagne.

SUMMARY OF THE INVENTION

Therefore, the main object of this invention is to provide a corkscrew which has a protective body so as to hide the pointed portion of the corkscrew in order to prevent accidents and in order to overcome all of the aforementioned drawbacks of the conventional corkscrew.

According to this invention, a corkscrew includes a hollow tubular protective body having an open upper end and an open lower end; a hollow inner cylinder disposed coaxially in an upper end portion of the protective body, the inner cylinder having an open upper end and an open lower end, the open upper end of the inner cylinder being connected securely to the upper end of the protective body such that an outer surface of the inner cylinder and an inner surface of the upper end portion of the protective body define cooperatively a positioning space therebetween; a cork drawing assembly including a generally T-shaped handle which has a vertical section with a lower end, and a spiral drawing element which has an upper end connected securely to the lower end of the vertical section of the handle and which has a pointed lower end adapted to be inserted into a cork of a bottle, the vertical section of the handle and the spiral drawing element extending into the protective body through the open upper end of the protective body, and the open upper end of the inner cylinder and the lower end of the inner cylinder such that the vertical section of the handle is mounted rotatably within the inner cylinder in order to insert the spiral drawing element into the cork of the bottle when the handle is rotated in one direction; a coiled spring disposed in the protective body and surrounding the inner cylinder and the spiral drawing element, the coiled spring having a lower end and an upper portion which is positioned in the positioning space; a positioning member disposed movably in the protective body, the positioning member having a bottom surface, a plurality of sharp protrusions protruding downward from the bottom surface, a top surface which abuts against the lower end of the coiled spring so that the coiled spring biases the positioning member away from the upper end of the protective body, and a central hole formed in the positioning member so as to permit extension of the pointed lower end of the spiral drawing element through the central hole and into the cork of the bottle; a guide unit for preventing rotation of the positioning member in the protective body while permitting longitudinal movement of the positioning member in the protective body; and a sleeve member having an open upper end, an open lower end, and an axial central counterbore formed therein, the open upper end of the sleeve member being connected securely to the open lower end of the protective body so as to prevent disengagement of the positioning member from the protective body through the lower end of the protective body, the counterbore being adapted to engage a neck of the bottle so as to prevent tilting of the cork drawing assembly relative to the bottle when the spiral drawing element of the cork drawing assembly is inserted into the cork of the bottle and is rotated.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
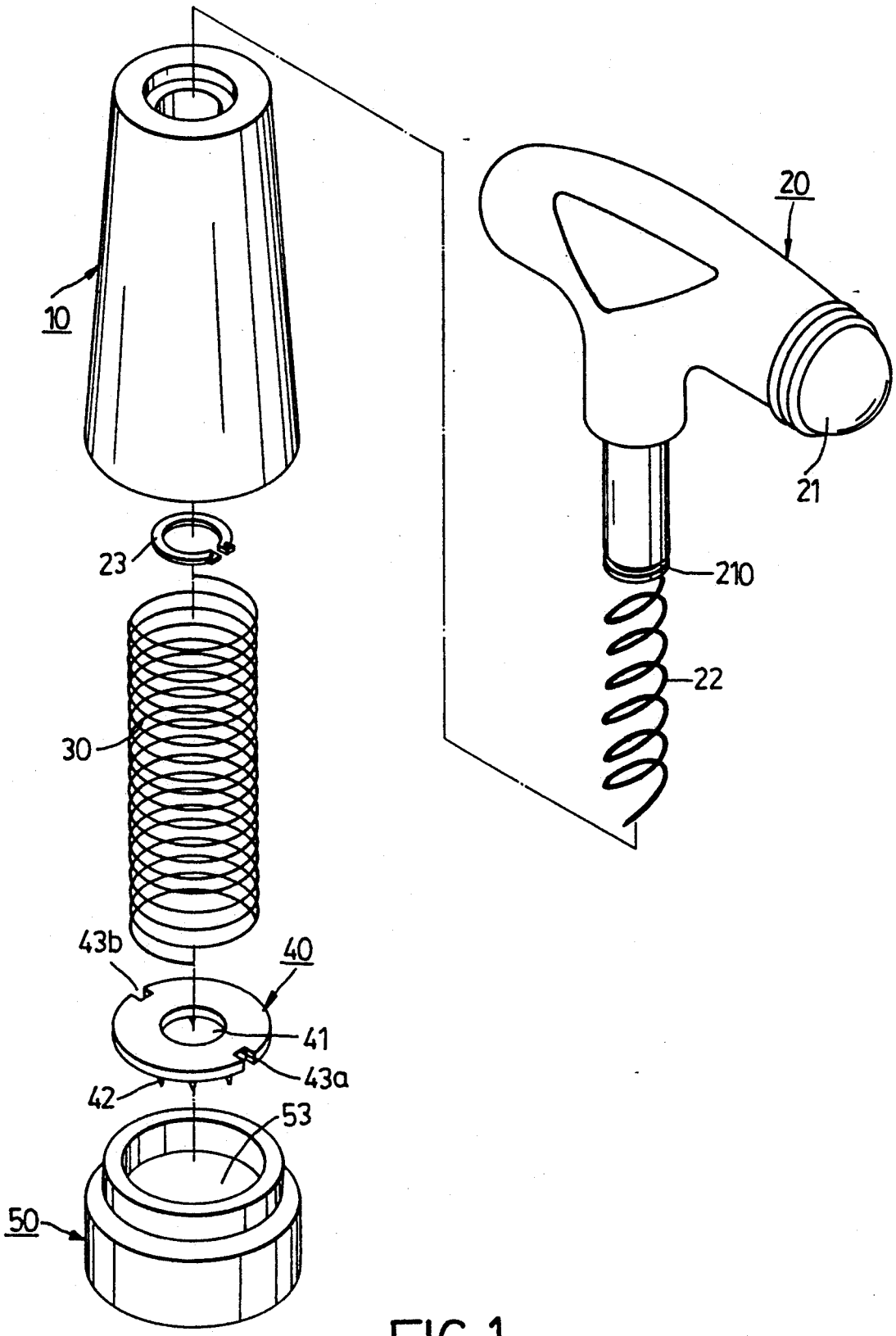
FIG. 1 is an exploded perspective view of a corkscrew according to this invention.
Figure 2:
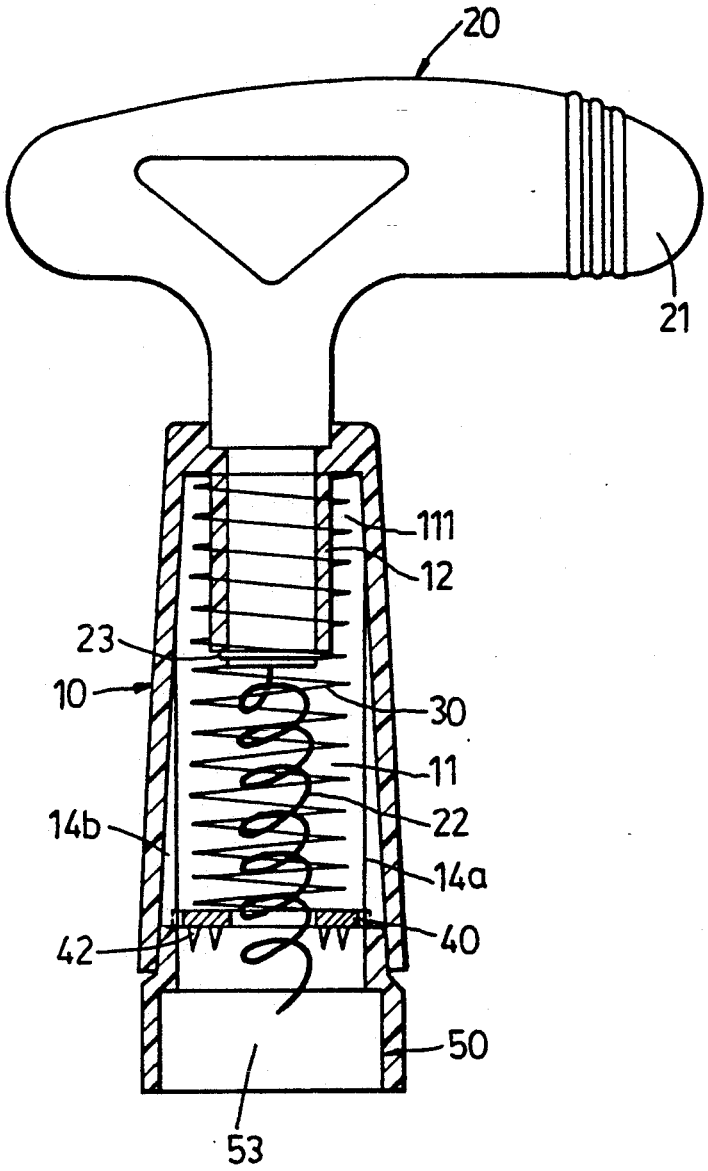
FIG. 2 is a partly sectional view of the corkscrew according to this invention.

Referring to FIGS. 1 and 2, a corkscrew according to this invention includes a hollow tubular protective body (10), a hollow inner cylinder (11), a cork drawing assembly (20), a coiled spring (30), a positioning member (40), and a sleeve member (50).

The protective body (10) is shaped in the form of a truncated cone and has an open upper end and an open lower end. The upper end of the protective body (10) has a diameter which is smaller than that of the lower end of the protective body (10). The protective body (10) further has two opposed guide ribs (14*a*,14*b*) which project inwardly from the inner surface thereof.

The hollow inner cylinder (12) is disposed coaxially in the upper end portion of the protective body (10). The inner cylinder (12) has an open upper end and an open lower end. The open upper end of the inner cylinder (12) is connected securely to the upper end of the protective body (10) such that the outer surface of the inner cylinder (12) and the inner surface of the upper end portion of the protective body (10) define cooperatively a positioning space (111) therebetween.

Figure 3:
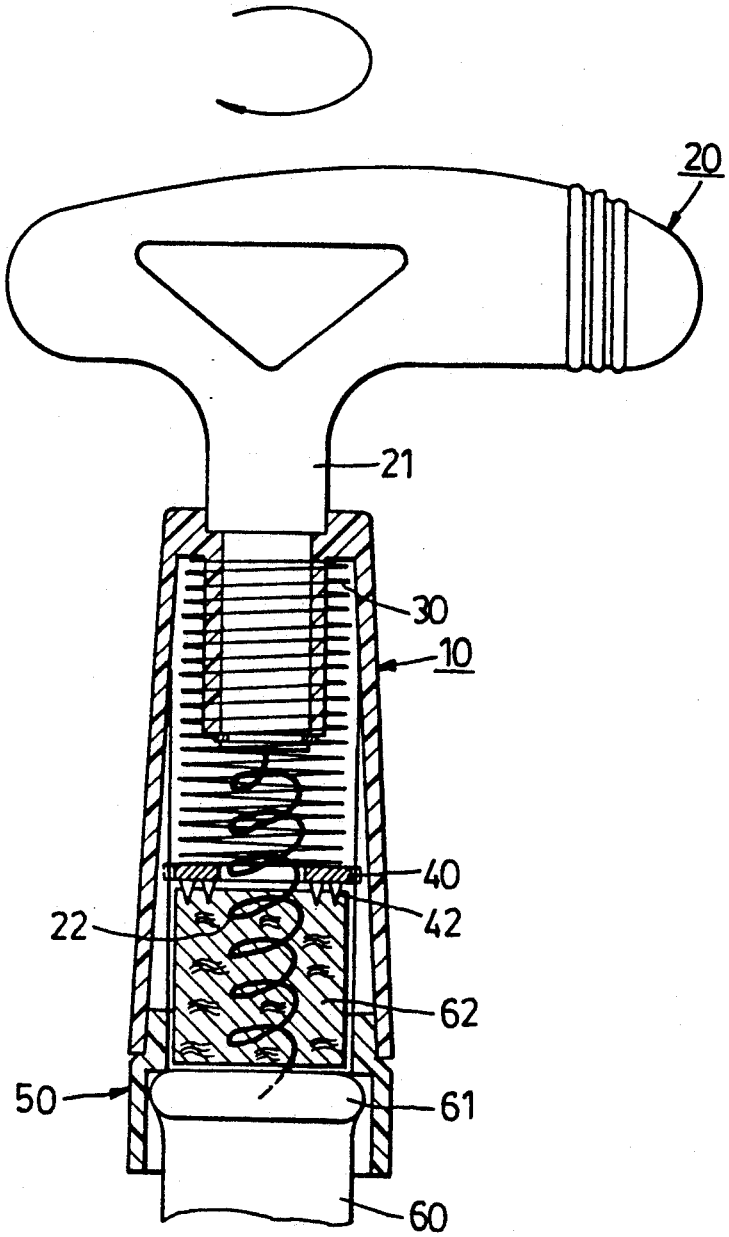
FIGS. 3 and 4 are partly sectional views showing the operation of the corkscrew according to this invention.

The cork drawing assembly (20) includes a generally T-shaped handle (21) which has a vertical section with a lower end, and a spiral drawing element (22) which has an upper end connected securely to the lower end of the vertical section of the handle (21) and which has a pointed lower end adapted to be inserted into a cork (62) of a bottle (60), as best illustrated in FIG. 3. The vertical section of the handle (21) and the spiral drawing element (22) extend into the protective body (10) through the open upper end of the protective body (10), the open upper end of the inner cylinder (12) and the lower end of the inner cylinder (12) such that the vertical section of the handle (21) is mounted rotatably within the inner cylinder (12) in order to insert the spiral drawing element (22) into the cork (62) of the bottle (60) when the handle (21) is rotated in one direction. The lower end of the vertical section of the handle (21) has an annular peripheral groove (210). The cork drawing assembly (20) further includes a retaining ring (23) which is engaged within the groove (210) in the lower end of the vertical section of the handle (21) so as to prevent upward movement of the cork drawing assembly (20) relative to the protective body (10) in order to prevent disengagement of the cork drawing assembly (20) from the protective body (10).

The coiled spring (30) is disposed in the protective body (10) and surrounds the inner cylinder (12) and the spiral drawing element (22). The coiled spring (30) has a lower end and an upper portion which is positioned in the positioning space (111).

The positioning member (40) is disposed movably in the protective body (10). The positioning member (40) has a bottom surface, a plurality of sharp protrusions (42) protruding downward from the bottom surface, a top surface which abuts against the lower end of the coiled spring (30) so that the coiled spring (30) biases the positioning member (40) away from the upper end of the protective body (10), a central hole (41) formed in the positioning member (40) so as to permit extension of the pointed lower end of the spiral drawing element (22) through the central hole (41) and into the cork (62) of the bottle (60), and two opposed notches which are formed in the periphery of the positioning member (40) and which engage the guide ribs (14*a*,14*b*) of the protective body (10) respectively. The two opposed vertical guide ribs (14*a*,14*b*) of the protective body (10) and the two opposed notches (43*a*,43*b*) of the positioning member (40) constitute cooperatively a guide unit which prevents rotation of the positioning member (40) in the protective body (10) while permitting longitudinal movement of the positioning member (40) in the protective body (10).

The sleeve member (50) has an open upper end, an open lower end, and an axial central counterbore (53) formed therein. The open upper end of the sleeve member (50) is connected securely to the open lower end of the protective body (10) by means of adhesives so as to prevent disengagement of the positioning member (40) from the protective body (10) through the lower end of the protective body (10). Referring to FIG. 3, the counterbore (53) is adapted to engage the neck (61) of the bottle (60) so as to prevent tilting of the cork drawing assembly (20) relative to the bottle (60) when the spiral drawing element (22) of the cork drawing assembly (20) is inserted into the cork (62) of the bottle (60) and is rotated.

Accordingly, the pointed lower end of the spiral drawing element (22) is hidden in the protective body (10) so as to prevent accidents from occurring. Referring to FIG. 3, when the preferred embodiment is in use, the counterbore (53) of the sleeve member (50) engages the neck (61) of the bottle (60). The protrusions (42) of the positioning member (40) are thus inserted into the top surface of the cork (62) so as to prevent rotation of the cork (62) relative to the bottle (60). The handle (21) of the cork drawing assembly (20) is rotated in a clockwise direction so as to force the pointed lower end of the spiral drawing element (22) of the cork drawing assembly (20) into the cork (62) of the bottle (60). Since only vertical movement of the cork (62) is permitted, the rotation of the spiral drawing element (22) is converted into the vertical movement of the cork (62). Hence, the cork (62) is moved upward and away from the neck (61) of the bottle (60) in such a manner that the lower end of the spiral drawing element (22) extends gradually into the cork (62) and the positioning member (40) is moved synchronously with the cork (62) so as to compress the coiled spring (30). Rotation of the handle (21) is continued until the cork (62) is removal from the bottle (60) and is disposed within the protective body (10). Therefore, wine in the bottle (60) is sprayed on the inner surface of the protective body (10) and not on the clothes of the user.

Figure 4:
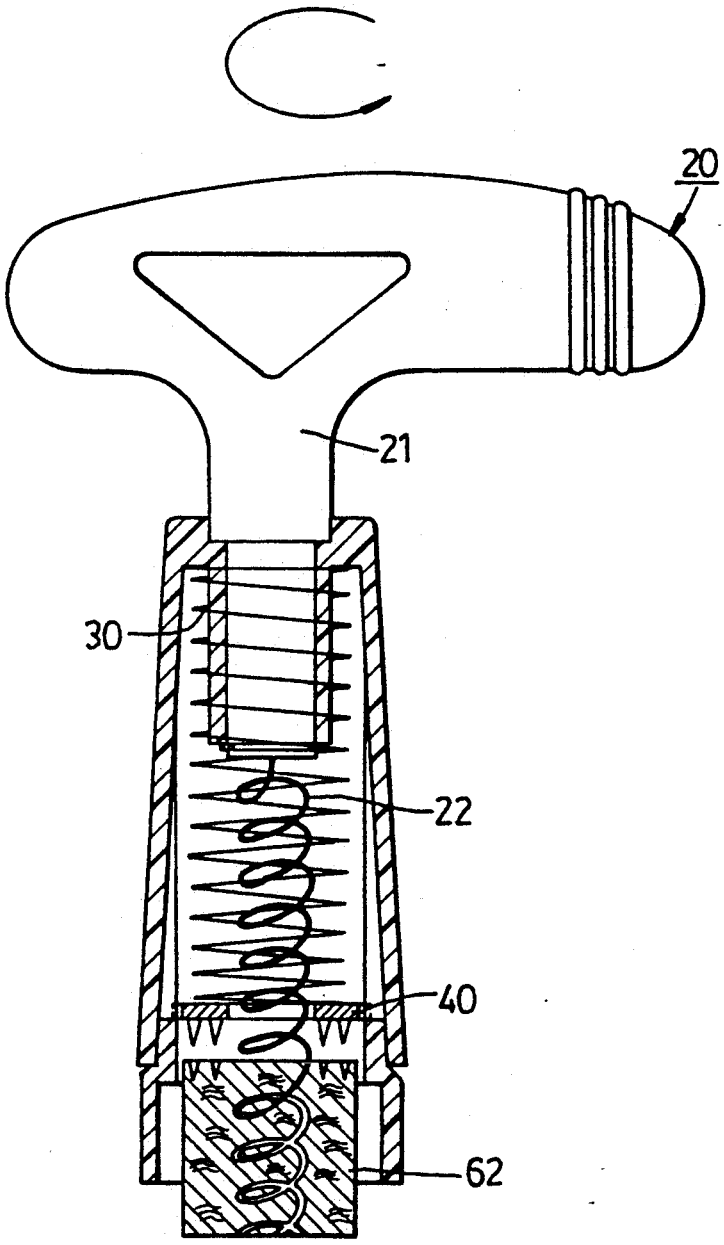

Referring to FIG. 4, when the cork (62) is removed from the bottle, the handle (21) is rotated in a counterclockwise direction so as to remove the cork (62) from the spiral drawing element (22). Rotation of the spiral drawing element (22) is converted into downward movement of the cork (62). As the cork (62) moves downward, the positioning member (40) moves synchronously with the cork (62) due to the biasing of the coiled spring (30), thereby causing the pointed lower end of the spiral drawing element (22) of the cork drawing assembly (20) to extend gradually out of the cork (62). The handle (21) of the cork drawing assembly (20) is rotated continuously until the pointed lower end of the spiral drawing element (22) is extended completely out of the cork (62).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A corkscrew comprising:

a hollow tubular protective body having an open upper end and an open lower end;

a hollow inner cylinder disposed coaxially in an upper end portion of the protective body, said inner cylinder having an open upper end and an open lower end, said open upper end of said inner cylinder being connected securely to said upper end of the protective body such that an outer surface of said inner cylinder and an inner surface of said upper end portion of said protective body define cooperatively a positioning space therebetween;

a cork drawing assembly including a generally T-shaped handle which has a vertical section with a lower end, and a spiral drawing element which has an upper end connected securely to said lower end of said vertical section of said handle and which has a pointed lower end adapted to be inserted into a cork of a bottle, said vertical section of said handle and said spiral drawing element extending into said protective body through said open upper end of said protective body, said open upper end of said inner cylinder and said lower end of said inner cylinder such that said vertical section of said handle is mounted rotatably within said inner cylinder in order to insert said spiral drawing element into said cork of said bottle when said handle is rotated in one direction;

a coiled spring disposed in said protective body and surrounding said inner cylinder and said spiral drawing element, said coiled spring having a lower end and an upper portion which is positioned in said positioning space;

a positioning member disposed movably in said protective body, said positioning member having a bottom surface, a plurality of sharp protrusions protruding downward from said bottom surface, a top surface which abuts against said lower end of said coiled spring so that said coiled spring biases said positioning member away from said upper end of said protective body, and a central hole formed in said positioning member so as to permit extension of said pointed lower end of said spiral drawing element through said central hole and into said cork of said bottle;

a guide unit for preventing rotation of said positioning member in said protective body while permitting longitudinal movement of said positioning member in said protective body; and a sleeve member having an open upper end, an open lower end, and an axial central counterbore formed therein, said open upper end of said sleeve member being connected securely to said open lower end of said protective body so as to prevent disengagement of said positioning member from said protective body through said lower end of said protective body, said counterbore being adapted to engage a neck of said bottle so as to prevent tilting of said cork drawing assembly relative to said bottle when said spiral drawing element of said cork drawing assembly is inserted into said cork of said bottle and is rotated.

2. A corkscrew as claimed in claim 1, wherein said lower end of said vertical section of said handle of said cork drawing assembly has an annular peripheral groove, said cork drawing assembly further including a retaining ring engaged within said groove in said lower end of said vertical section of said handle so as to prevent upward movement of said cork drawing assembly relative to said protective body in order to prevent disengagement of said cork drawing assembly from said protective body.

3. A corkscrew as claimed in claim 1, wherein said protective body is shaped in the form of a truncated cone, said upper end of said protective body having a diameter which is smaller than that of said lower end of said protective body, said guide unit including two opposed vertical guide ribs projecting inward from an inner surface of said protective body, and two opposed notches being formed in a periphery of said positioning member and engaging respectively said guide ribs.

* * * * *